US012043457B2

(12) United States Patent
Bailey et al.

(10) Patent No.: US 12,043,457 B2
(45) Date of Patent: Jul. 23, 2024

(54) CHILD-RESISTANT CONTAINER

(71) Applicant: GlaxoSmithKline Consumer Healthcare Holdings (US) LLC, Wilmington, DE (US)

(72) Inventors: Martin Bailey, Warren, NJ (US); Sriman Banerjee, Warren, NJ (US); Grace A. Behrend, Warren, NJ (US); James C. O'Hara, Warren, NJ (US); Kai Tiesberger, Weinheim (DE)

(73) Assignee: HALEON US HOLDINGS LLC, Wilmington, DE (US)

( * ) Notice: Subject to any disclaimer, the term of this patent is extended or adjusted under 35 U.S.C. 154(b) by 266 days.

(21) Appl. No.: 17/414,415

(22) PCT Filed: Dec. 16, 2019

(86) PCT No.: PCT/US2019/066463

§ 371 (c)(1),
(2) Date: Jun. 16, 2021

(87) PCT Pub. No.: WO2020/131669

PCT Pub. Date: Jun. 25, 2020

(65) Prior Publication Data

US 2022/0041344 A1 Feb. 10, 2022

Related U.S. Application Data

(60) Provisional application No. 62/780,378, filed on Dec. 17, 2018.

(51) Int. Cl.

| | |
|---|---|
| ***B65D 43/22*** | (2006.01) |
| ***B65D 45/28*** | (2006.01) |
| ***B65D 50/04*** | (2006.01) |

(52) U.S. Cl.
CPC ..... *B65D 43/22* (2013.01); *B65D 45/28* (2013.01); *B65D 50/04* (2013.01); *B65D 2215/02* (2013.01); *B65D 2251/1058* (2013.01)

(58) Field of Classification Search
CPC ..... B65D 43/22; B65D 45/28; B65D 50/04; B65D 2251/1058
(Continued)

(56) References Cited

U.S. PATENT DOCUMENTS 5,230,433 A * 7/1993 Hamilton ..... B65D 50/046 215/221
5,449,077 A 9/1995 Seidler
(Continued)

FOREIGN PATENT DOCUMENTS

DE 102014117722 A1 * 6/2016
EP 3939558 A1 * 1/2022
(Continued)

OTHER PUBLICATIONS

Translation of DE 102014117722 provided by Espacenet. https://worldwide.espacenet.com/publication Details/original Document?CC=DE&NR=102014117722A1&KC=A1&FT=D&ND=3&date=20160602&DB=EPODOC&locale=en_EP (Year: 2023).*

*Primary Examiner* — James N Smalley

(57) ABSTRACT

Aspects of the present invention are directed to a child-resistant container comprising a lid and a vial. The lid has a side wall, an inner surface and a lid cover. The lid cover includes a top, a bottom, and a front surface and at least two lid hooks protruding from the bottom surface. The vial contains an opening accessing a cavity and a rim extending around at least a portion of the opening, the rim having at least two moveable tabs partially affixed to the rim and movable about a pivot point. The movable tabs contain tab hooks above the pivot point for engaging with the lid hooks to secure the lid cover to the vial. The moveable tabs are
(Continued)

displaceable outwardly away from the lid to disengage the tab hooks from the lid hooks by pressing inwardly on the moveable tabs below the pivot point.

12 Claims, 5 Drawing Sheets

(58) Field of Classification Search
USPC ..... 215/216, 237
See application file for complete search history.

(56) References Cited

U.S. PATENT DOCUMENTS

| | | | | |
|---|---|---|---|---|
| 8,469,212 | B2 | 6/2013 | Goto et al. | |
| 2007/0228042 | A1 | 10/2007 | Yeager | |
| 2007/0251909 | A1 | 11/2007 | Decelles et al. | |
| 2010/0089861 | A1 | 4/2010 | Rutter et al. | |
| 2010/0206877 | A1 | 8/2010 | Logel et al. | |
| 2010/0252458 | A1* | 10/2010 | Guillon | B65D 81/268 206/204 |
| 2011/0114591 | A1 | 5/2011 | Glroud et al. | |
| 2015/0344202 | A1 | 12/2015 | Schneider et al. | |
| 2015/0366755 | A1* | 12/2015 | Milante | B65D 43/0218 215/203 |
| 2016/0130049 | A1 | 5/2016 | Rogers et al. | |
| 2016/0311587 | A1 | 10/2016 | Schneider et al. | |
| 2017/0001764 | A1* | 1/2017 | Belleville | B65D 43/162 |
| 2020/0010250 | A1* | 1/2020 | Herling | B65D 47/066 |
| 2021/0276769 | A1* | 9/2021 | Dzurik | B65D 47/08 |

FOREIGN PATENT DOCUMENTS

| | | |
|---|---|---|
| JP | 2005-15050 | 1/2005 |
| JP | 2013-536131 | 9/2013 |
| TW | M472685 U | 2/2014 |
| WO | 2012011941 A1 | 1/2012 |
| WO | WO 2016/087213 A1 | 6/2016 |

* cited by examiner

CHILD-RESISTANT CONTAINER

This application is a 371 of International Application No. PCT/US2019/066463, filed 16 Dec. 2019, which claims the benefit of U.S. Provisional Application: U.S. 62/780,378 filed 17 Dec. 2018.

TECHNOLOGY FIELD

Aspects of the present invention are directed to a child-resistant container.

BACKGROUND

Child-resistant closures designed to prevent children from ingesting potentially dangerous substances are a priority for companies selling products that may be dangerous to children if ingested without adult supervision. This is particularly true for pharmaceutical and consumer healthcare companies. Current statistics show that almost a third of reported pediatric exposures to toxic substances were due to inadvertent drug ingestion. Further, over seventy percent of resulting pediatric fatalities are due to unintended exposure to dangerous substances.

Thus, child-resistant packaging has been an area of significant research over the past several decades. Known child-resistant closures include apparatuses that require the user to:

line up indicators on the cap with the bottle, push down the cap while turning, squeeze the sides of the cap, or squeeze tabs and then turning a cap. These types of closures meet the standard of being child-resistant, and they are effective at reducing the risk of inadvertent pediatric drug exposure. However, child-resistant closures can be problematic for adults with manual dexterity issues.

Consumers with arthritis and people with disabilities have a higher per capita rate of consumption of both OTC and prescription drugs. Opening medicine bottles with child-resistant closures may cause painful strain on carpometacarpal joints of users with arthritis and similar conditions. Difficulty opening child-resistant closures has been given as a reason for deviating from prescribed drug dosing regimens. Consequently, a child-resistant container that is easily manipulated by adults with manual dexterity issues would be highly desirable.

SUMMARY

Aspects of the present invention are directed to a child-resistant container comprising:

a lid having a side wall, an inner surface and a lid cover, the lid cover including a top surface, a bottom surface, a front surface, and at least two lid hooks protruding from the bottom surface; and a vial having a top, a bottom, and a side wall, the top containing an opening accessing a cavity and a rim extending around at least a portion of the opening, the rim having at least two moveable tabs partially affixed to the rim and movable about a pivot point, wherein the movable tabs contain tab hooks above the pivot point for engaging with the lid hooks to secure the lid cover to the vial, and wherein the moveable tabs are displaceable outwardly away from the lid to disengage the tab hooks from the lid hooks by pressing inwardly on the moveable tabs below the pivot point.

The present invention further provides that the lid hooks of the child-resistant container are located on opposing sides of the lid and the moveable tabs of the child-resistant container are located on opposing sides of the vial. The present invention further provides that the lid hooks do not extend beyond a perimeter of the lid of the child-resistant container. The present invention further provides that the tab hooks do not extend above the top of the tabs of the vial of the child-resistant container.

The present invention further provides that the lid cover of the child-resistant container comprises a plug having a side wall and the inner surface of the lid comprises a plug opening accessing the cavity of the vial. The present invention further provides that the plug on the bottom surface of the lid cover fits into the plug opening to seal the plug opening when the child-resistant container is in a closed position. The present invention further provides that the seal between the plug and the plug opening is moisture tight and resealable.

The present invention further provides that the lid comprises at least two guides extending from the bottom surface of the lid to direct content within the vial through the plug opening. The present invention further provides that the guides are positioned on opposing sides around the plug opening.

The present invention further provides that the lid of the child-resistant container comprises a chamber having a top surface, bottom surface and a side wall extending around at least a portion of the circumference of the chamber, wherein the chamber is attached to the bottom surface of the lid. The present invention further provides that the chamber comprises a desiccant reservoir to hold a desiccant extending from the bottom surface of the lid into the cavity of the vial. The present invention further provides that the desiccant is in the form of silica gel beads.

The present invention further provides that the child-resistant container is 100% child resistant as determined by a Child-Resistant Test. The present invention also provides that the child-resistant container is 100% senior friendly as determined by a Senior Adult Test.

DETAILED DESCRIPTION

FIGS. 1 through 9D are based upon engineering drawings used for the development of the child-resistant container 10. Hence, the drawings are to scale and representative of the geometry of the child-resistant container 10 comprising a lid 100 and a vial 200 according to the present invention.

Aspects of the present invention are directed to a child-resistant container 10 comprising a lid 100 and a vial 200.

Figure 2:
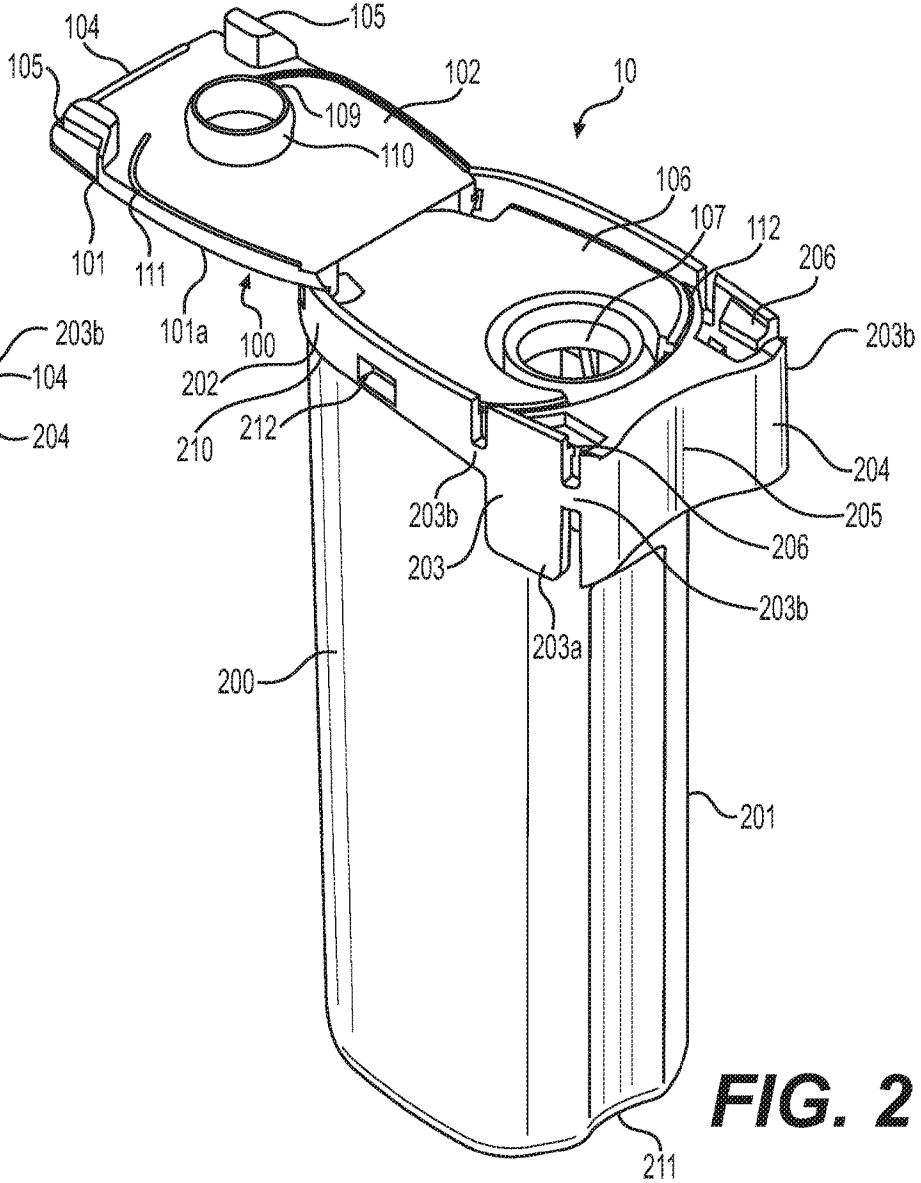
FIG. 2 is a top perspective view of an embodiment of the present invention in the opened position.
Figure 1:
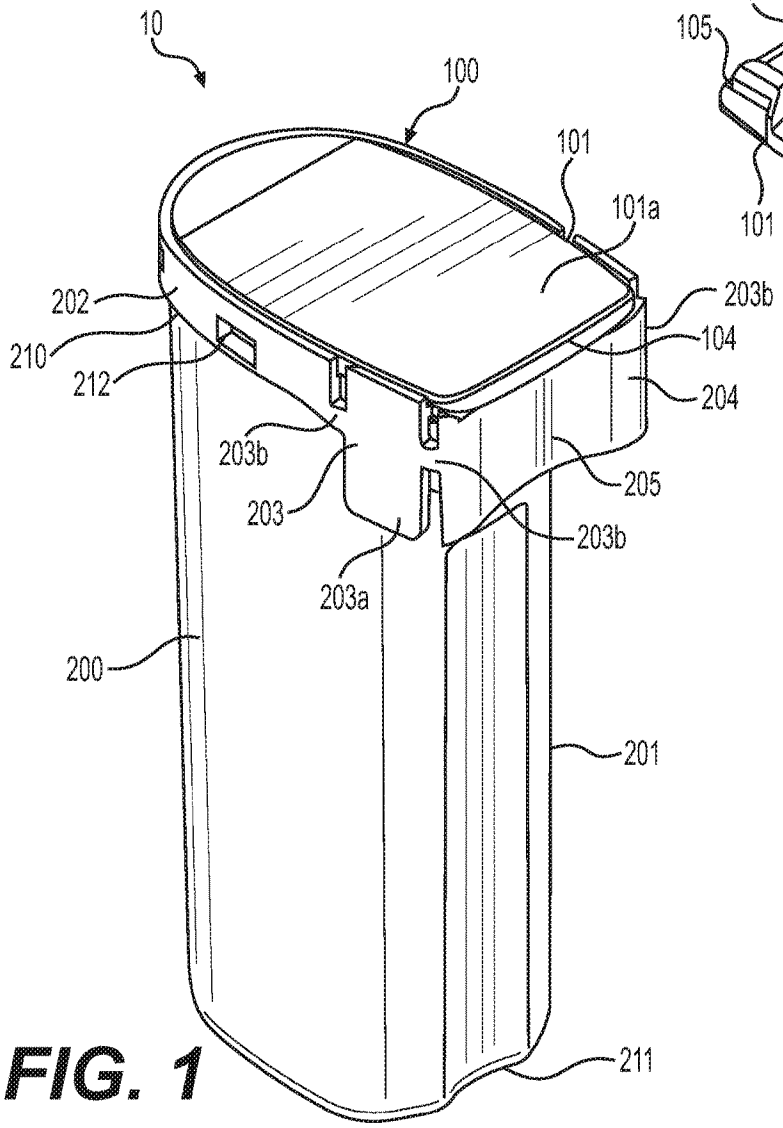
FIG. 1 is a top perspective view of an embodiment of the present invention in the closed position.

The child-resistant container 10 in accordance with the present invention is generally depicted in FIGS. 1 and 2. FIGS. 1 and 2 show an exemplary child-resistant container 10 of the present invention in a closed position (FIG. 1) and in an opened position (FIG. 2). The lid 100 comprises a lid cover 101 having top surface 101*a*, a bottom surface 102, a front surface 104, and at least two lid hooks 105 protruding from the bottom surface 102. In a closed position, the lid hooks 105 extend in a downward direction from the bottom surface 102 towards the vial 200. In a preferred embodiment, the lid cover 101 has two lid hooks 105. The lid 100 further includes an inner surface 106 that is flat and provided on the vial 200. In a preferred embodiment, the inner surface 106 is stationary and does not move during opening and closing of the child-resistant container 10.

The vial 200 comprises a side wall 201, a top 210, and a bottom 211, the top 210 containing an opening allowing access to a cavity 11 defined by the vial 200. Contents may be held in the cavity 11. In an embodiment, the side wall 201 may have a curved shape. In another embodiment, the side wall 201 may have a straight shape. The height of the vial 200 may be between about 50.0 mm and about 75.0 mm. In a preferred embodiment, the height of the vial 200 is about 64.6 mm. The inner surface 106 of the lid 100 is provided on the top 210 of the vial 200 so as to cover the cavity 11. The vial 200 further includes a rim 202 extending around at least a portion of the opening, the rim 202 having at least two moveable tabs 203 partially affixed to the rim 202 and movable about at least one pivot point 203*b*. The pivot point 203*b* has a height between about 1 mm and about 2.5 mm. In a preferred embodiment, the height of the pivot point is about 1.8 mm. In a preferred embodiment, the child-resistant container 10 has two moveable tabs 203 each moveable about two pivot points 203*b*. The moveable tabs 203 are provided towards the leading edge of the vial 200 in use.

The rim 202 also includes a front portion 204 extending along the entire front of the rim 202 and contoured to include a finger recess 205 to comfortably fit the finger of a user opening the child-resistant container 10. The moveable tabs 203 are located on either side of the front portion 204 along the rim 202 of the vial 200. In a preferred embodiment, each of the moveable tabs 203 is connected to the front portion 204 by one pivot point 203*b* and connected to the rim 202 by another pivot point 203*b* on the opposite side of the moveable tab 203. In a preferred embodiment, the moveable tabs 203 have a generally rectangular shape; however, the shape of the moveable tabs 203 is not limited and can be any suitable shape and size.

Each movable tab 203 further contains a tab hook 206 provided above the pivot point 203*b* on an inner surface of the moveable tab 203 for engaging with the lid hooks 105 to secure the lid cover 101 to the vial 200 in the closed position. The movable tabs 203 are displaceable outwardly away from the vial 200 to disengage the tab hooks 206 from the lid hooks 105 by pressing inwardly on the moveable tabs 203 below the pivot point 203*b*. The moveable tabs 203 may move about pivot points 203*b* by pressing a lower portion 203*a* of the moveable tabs 203 in an inward direction towards the vial 200.

A plug opening 107 is provided on the inner surface 106 of the lid 100 for accessing the cavity 11 of the vial 200. Contents may be dispensed out of the vial 200 via the plug opening 107. In a preferred embodiment, the plug opening 107 is circular and is located towards a front portion of the inner surface 106. The shape and size of the plug opening 107 is not limited and may be any shape and size to accommodate the contents held in the vial 200.

The bottom surface 102 of the lid cover 101 includes a plug 109 designed to fit within the plug opening 107 when the lid cover 101 is closed. Plug 109 fits within the plug opening 107 and seals the plug opening 107 to form an airtight seal. The seal is formed by compression as plug side wall 110 has a convex structure to form a compression seal within the plug opening 107. The bottom surface 102 of the lid cover 101 also includes a ridge 111 that fits within a groove 112 formed between the inner surface 106 and the rim 202 of the vial 200. When in the closed position, the ridge 111 fits within groove 112 and provides an additional seal in order to reduce the amount of air and moisture that can reach the contents held within the child-resistant container 10. In a preferred embodiment, the lid 100 and the vial 200 are formed from two different grades of polypropylene with one being harder and one being softer which creates a strong and secure seal between the plug 109 and plug opening 107.

The present invention may be formed through the combination of a lid 100 and a vial 200 formed either integrally or non-integrally. If the lid 100 is integrally connected to the vial 200, the lid 100 and the vial 200 may be formed of a blow-molded material or injection molded using methods know to one skilled in the art. Those non-integrally connected may be connected, for example, by being screwed on to external or internal threads or snap fitted with an annular ring. Preferably, the lid 100 is permanently fixed to the interior wall of the body of the vial 200 after or before the vial 200 is filled, thereby rendering the vial 200 and lid 100 into a connected system. The lid 100 may be permanently fixed to the vial 200 by any suitable manner known in the art. For example, the lid 100 and the vial 200 may be sized so as to provide a friction fit for the lid 100. Alternatively, the lid 100 may be permanently attached via a mechanical snap. Although it is preferable to permanently fix the lid 100 to the body of the vial 200 after the vial 200 is filled, it will be appreciated by those of skill in the art that such a permanent fixture may not be necessary.

Figure 3:
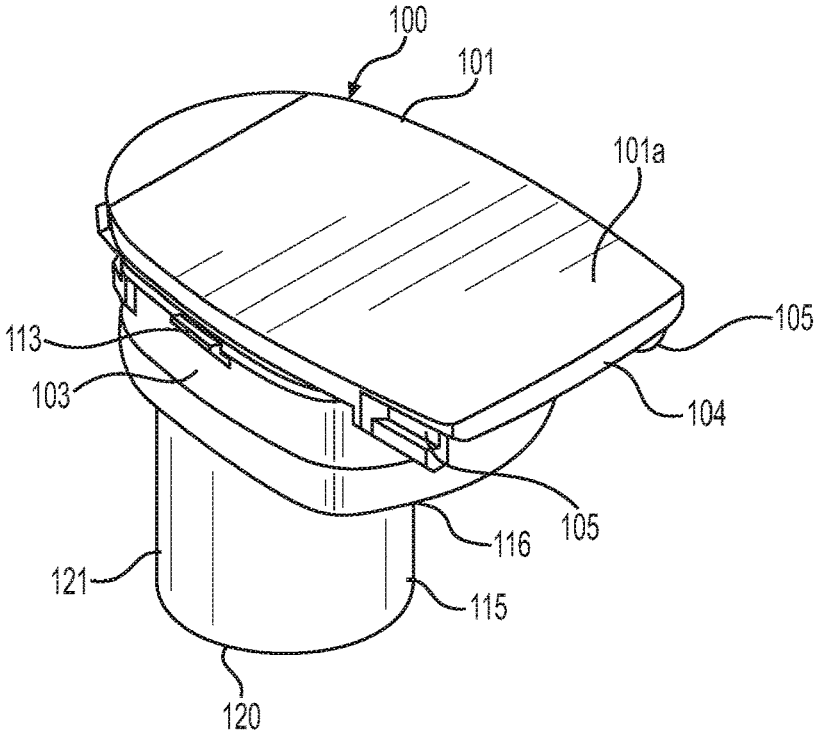
FIG. 3 is a top perspective view of a lid of the present invention in the closed position.

FIG. 3 illustrates a perspective view showing an exemplary lid 100 in the closed position removed from the vial 200. The lid 100 includes a side wall 103. When the lid 100 is fixed to the vial 200, the side wall 103 of the lid 100 is provided inside the body of the vial 200. The lid 100 further includes a chamber 115 which extends into the vial 200. The chamber 115 includes a top surface 116, a bottom surface 120, and a side wall 121 extending around at least a portion of the circumference of the chamber 115. The top surface 116 of the chamber 115 is attached to the bottom surface of the lid 100. The chamber 115 comprises a desiccant reservoir 117 and extends from the bottom surface of the lid 100 into the vial cavity 11. The side wall 121 of the chamber 115 is physically crimped down to secure a food grade paperboard plug which retains the desiccant in place within the chamber 115. The desiccant reservoir 117 being provided on the lid 100 and sealed within the chamber 115 provides additional stability for the contents held in the vial 200 as compared to a desiccant reservoir provided in the vial 200. The desiccant absorbs and holds water vapor and protects the contents of the vial 200 from exposure to moisture. In a preferred embodiment, the desiccant is in the form of silica gel beads.

Figure 4:
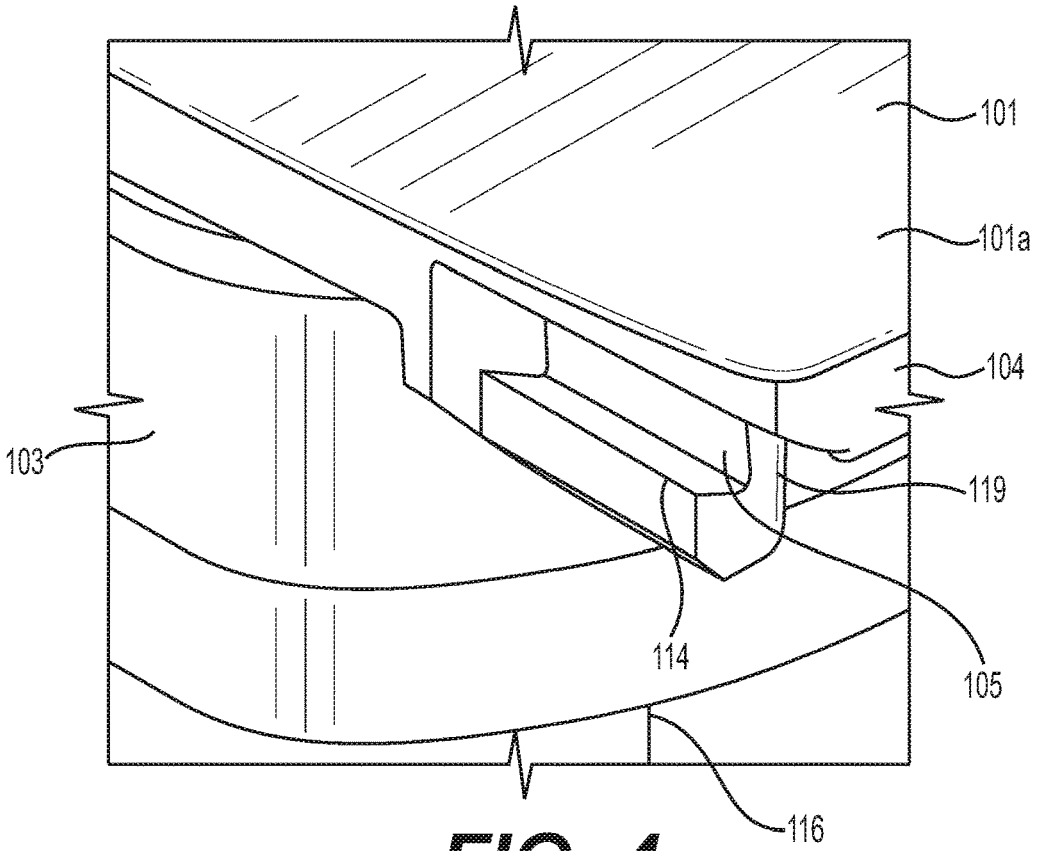
FIG. 4 is an exploded perspective view of a lid hook of the present invention.

FIG. 4 is an exploded view of an exemplary lid hook 105 of the lid 100 in the closed position removed from the vial 200. In a preferred embodiment, each of the lid hooks of the present invention have the same structure and function. In the closed position, the lid hooks 105 extend downward from the lid cover bottom surface 102. Furthermore, the lid hooks 105 are provided adjacent to the side wall 103 towards the front surface 104 of the lid cover 101 and do not extend beyond the side wall 103. The lid hooks include a top portion 119 attached to the lid cover bottom surface 102 and a lip portion 114 attached to the top portion 119. When the child resistant container 10 is in the closed position, the lid hooks 105 engage with the tab hooks 206 of the vial 200 to prevent the removal of the lid cover 101 of the lid 100 from the vial 200 when the lid cover 101 is moved in an axial direction by a user. This locking mechanism of the lid hooks 105 with the tabs hooks 206 prevents children from inadvertently accessing the contents of the vial 200 and makes the container child-resistant.

Figure 5:
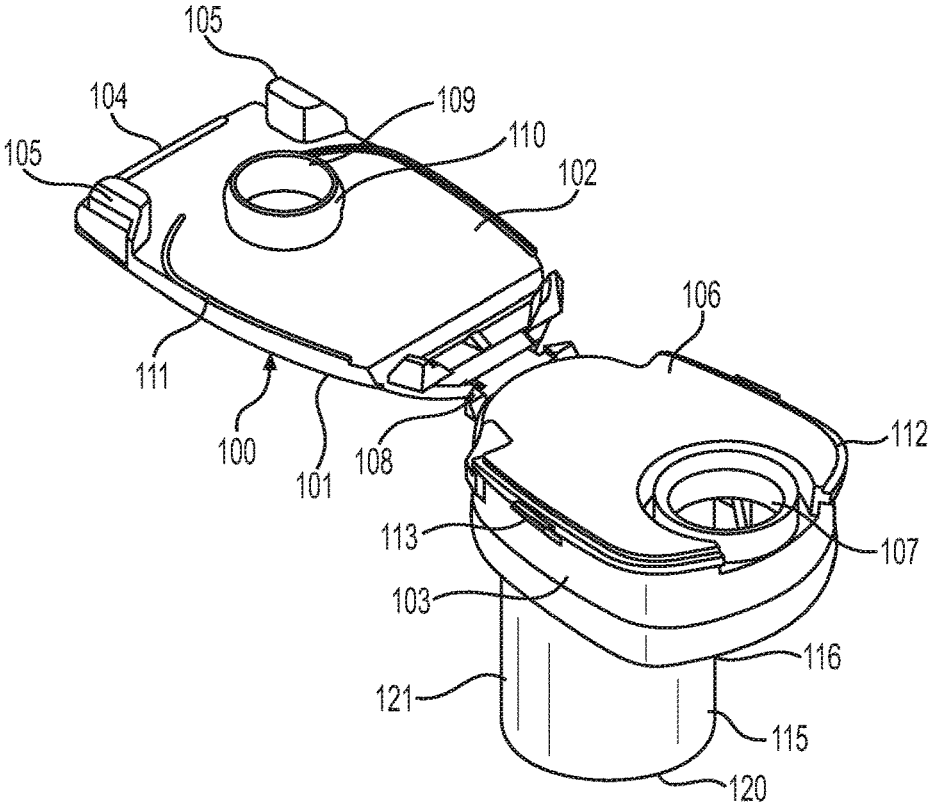
FIG. 5 is a top perspective view of a lid of the present invention in the open position.

FIG. 5 shows an exemplary lid 100 in the open position removed from the vial 200. When the moveable tabs 203 are pressed simultaneously at the lower portion 203*a* by a user, the lid hooks 105 disengage from the tab hooks 206 and the lid cover 101 can be removed from vial 200 by lifting the front surface 104 of the lid cover 101 in an upward direction. A user may use the finger recess 205 to place their thumb or other finger and readily lift a portion of the front surface 104 of the lid cover 101 that extends over the finger recess 205.

The lid cover 101 is attached to the inner surface 106 of the lid 100 via a hinge 108 and pivots about the hinge 108 during opening and closing. The lid 100 further includes a retention notch 113 which is snap fitted into a corresponding retention groove 112 provided on the vial 200 in order to secure the lid 100 to the vial 200. The connection of the retention notch 113 with the retention groove 212 ensures that the side wall 103 and the inner surface 106 of the lid 100 do not disengage from the vial 200 when the lid cover 101 is opened.

Figure 6:
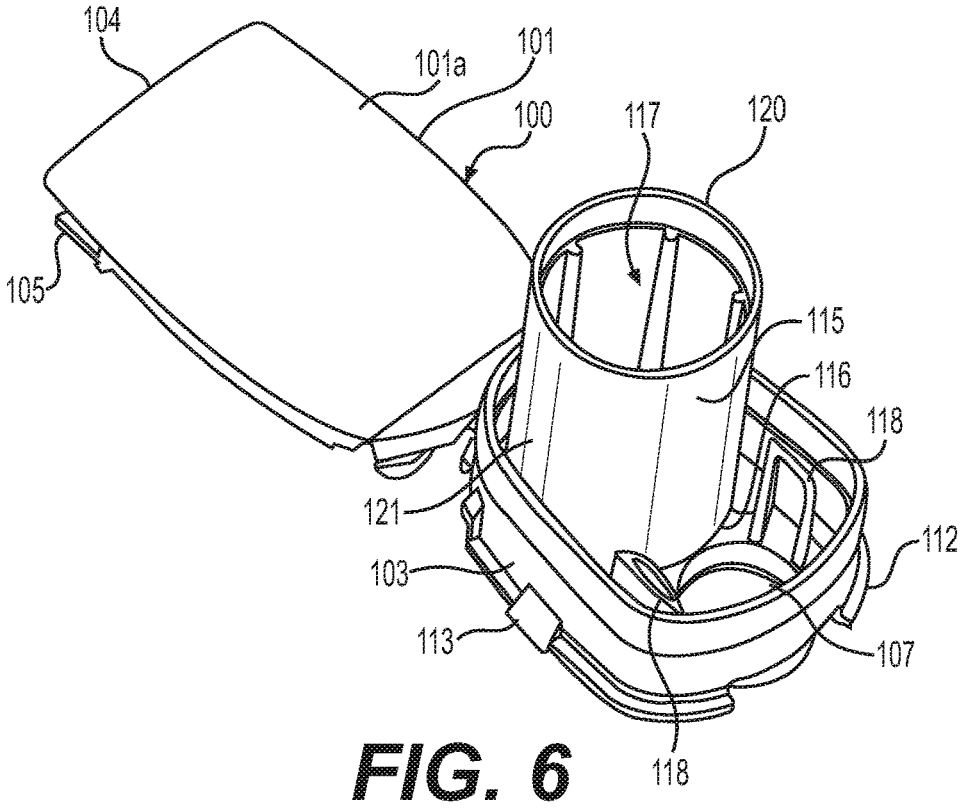
FIG. 6 is a bottom perspective view of a lid of the present invention in the open position.

FIG. 6 illustrates a bottom perspective view of an exemplary lid 100 in the open position removed from the vial 200. The bottom of the lid 100 includes at least two guides 118 extending from the back surface of the circumference of the plug opening 107. In a preferred embodiment, the guides 118 are positioned on opposing sides around the plug opening 107. The guides 118 help to direct the contents held in the vial 200 out of the plug opening 107 of the lid 100. When a user opens the child-resistant container 10 and tilts the container to remove the contents, the guides 118 ensure that the contents are directed out of the plug opening 107 and not to any other portion of the lid 100 where the contents may not be accessible to the user. The guides 118 are generally a U shape but the shape of the guides is not limited and can be any suitable shape and size.

Figure 7:
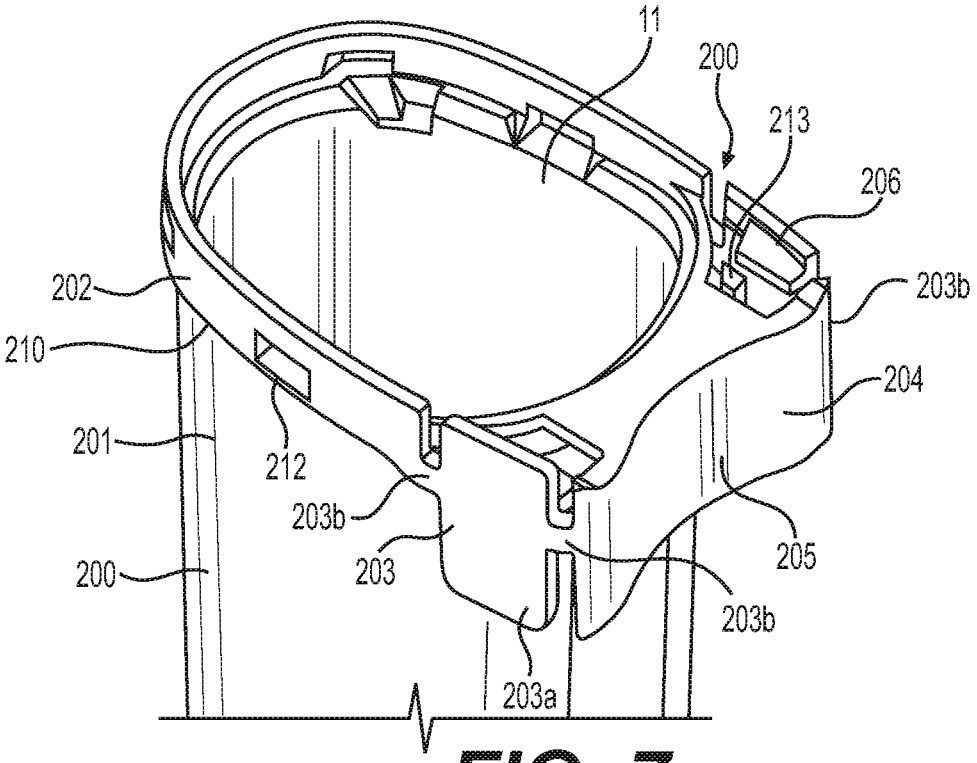
FIG. 7 is a top view of a vial of the present invention.
Figure 8:
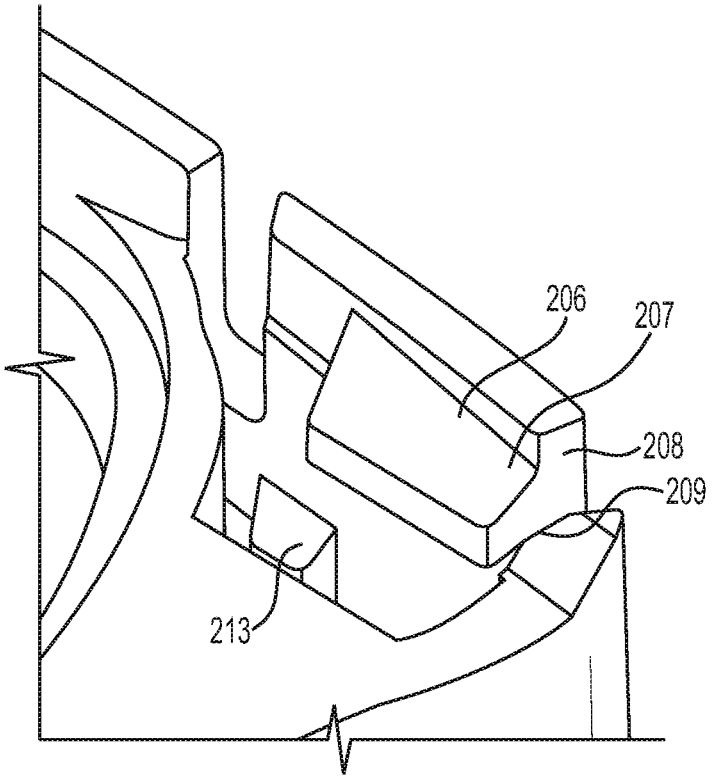
FIG. 8 is an exploded perspective view of a tab hook of the present invention.
Figure 9B:
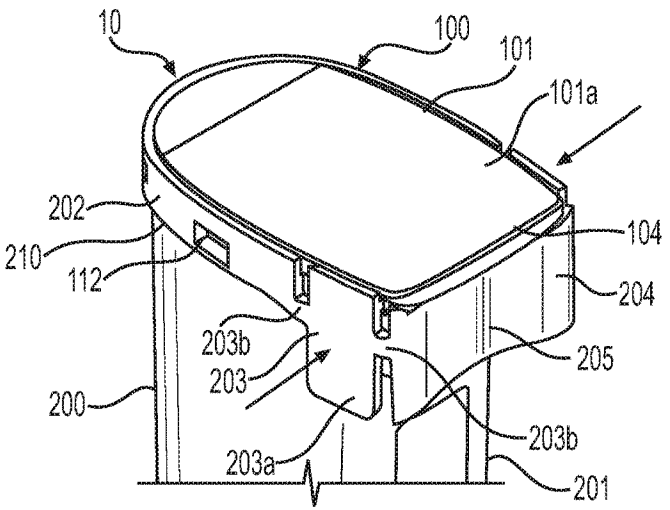
FIGS. 9A-9D demonstrate an exemplary method of using the container of the present invention.
Figure 9A:
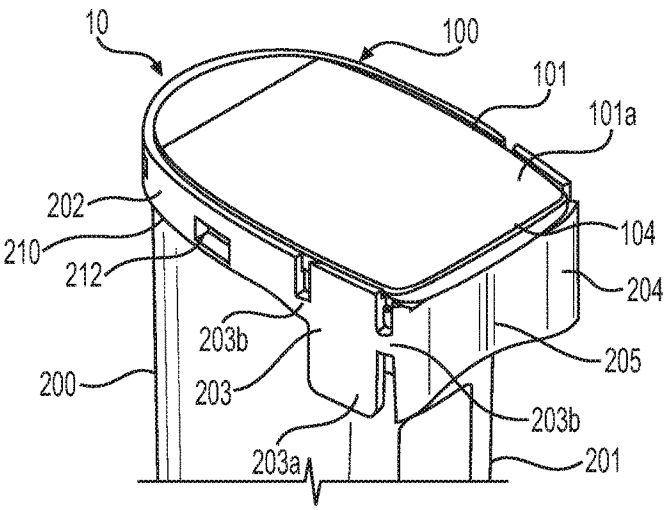
Figure 9D:
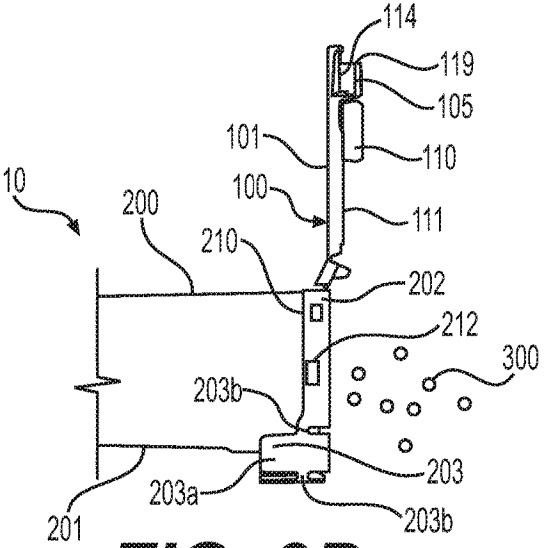
Figure 9C:
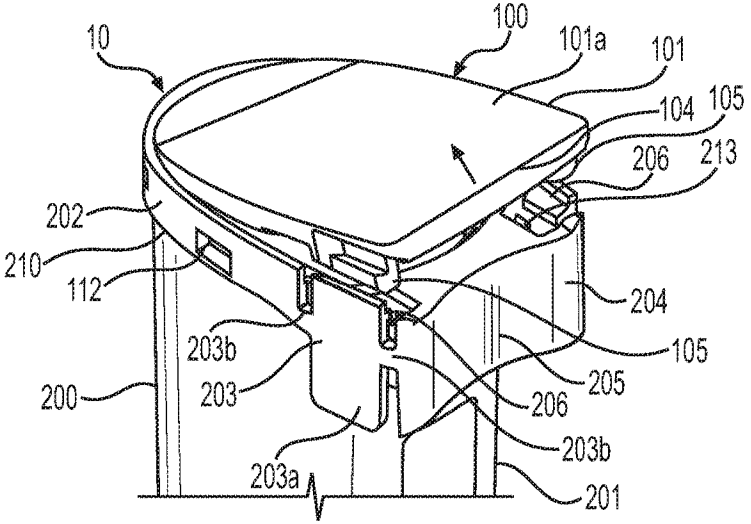

FIGS. 7 and 8 show an exemplary vial 200 with the lid 100 removed. The cavity 11 is provided at the top 210 of the vial 200 to hold the contents within the vial 200. The rim 202 extends around at least a portion of the opening defining the cavity 11. FIG. 8 shows an exploded perspective view of an exemplary tab hook 206 of the vial 200. In a preferred embodiment, each of the tab hooks of the present invention have the same structure and function. The tab hooks 206 are connected to the inner surface of the moveable tabs 203. The tab hooks 206 include a top 207, a side 208, and an underside surface 209. The tab hooks are positioned so as to fit the tapered surface of the lid hooks 105 underneath the underside surface 209 of the tab hooks 206 to form a lock when the child-resistant container 10 is in the closed position. The tab hooks 206 and the lid hooks 105 fit together when the child-resistant container 10 is in the closed position in an interlocking S configuration. In this configuration, the underside surface 209 of each of the tab hooks 206 is provided on the top of the lip 114 of each of the lid hooks 105 to hold the lid cover 101 in place. When the moveable tabs 203 are pressed simultaneously to release the lid cover 101 from the locked position, the tab hooks 206 move outwardly from the vial 200 and disengage the lip 114 of the lid hooks 105 from the underside surface 209 of the tab hooks 206. This allows the lid cover 101 to be removed from the vial 200 by a user with an upward motion.

Since there is no turning of the lid required to open the child-resistant container 10, the lid 100 is easier to operate for senior adults who may suffer from arthritis and may have difficulty manipulating small items. Additionally, the moveable tabs 203 must be depressed inwardly simultaneously while lifting the lid cover 101 in an axial direction in order to open the container 10; therefore, the container 10 is child-resistant and prevents children from accessing the container held within.

The vial 200 further includes at least two ribs 213 provided on an inner surface of the front 204 of the rim 202 of the vial 200. The ribs 213 are located opposite to the tab hooks 206 so as to be facing the tab hooks with a gap provided in between. The ribs 213 prevent the corresponding moveable tabs 203 from being depressed beyond the intended amount in order to prevent damage to the child-resistant container 10. When the moveable tabs 203 are depressed to the intended amount, the moveable tabs 203 contact the ribs 213 which provides a mechanical stop and prevent the moveable tabs 203 from being depressed further and damaging the child-resistant container 10.

FIG. 9 depicts an exemplary method of using the child-resistant container 10 of the present invention. FIG. 9A shows the child-resistant container 10 in a closed position wherein the lid hooks 105 of the lid 100 are engaged with the tab hooks 206 of the vial 200. FIG. 9B illustrates the process of opening the child-resistant container. As indicated by the arrows, the moveable tabs 203 must be simultaneously pressed by a user at the lower portion 203*a* of each of the moveable tabs 203 in order to disengage the lid hooks 105 from the tab hooks 206. Once the moveable tabs 203 are pressed, FIG. 9C, shows that the front surface 104 of the lid cover 101 can be lifted upwards using the finger recess 205 on the front 204 of the rim 202 of the vial 200 in order to open the child-resistant container 10. Thereafter, as shown in FIG. 9D, the contents 300 of the child-resistant 10 container can be accessed. Exemplary contents 300 of the child-resistant container 10 include, for example, pharmaceutical medicines, consumer healthcare products, toxic materials, caustic materials, among others.

In one embodiment, the child-resistant container 10 is moisture-tight and is resealable to maintain the moisture tight properties. As used herein, the term "resealable" means that the container can be opened/reopened and closed or reclosed a numerous amount of times (e.g. more than 5 times) and still retain its moisture-tight properties. As used herein, the term "moisture tight" means the moisture ingress of the container is less than about 1500 micrograms of water/day, determined by the following test method: (a) place approximately one gram of molecular sieve in the container and record the weight; (b) close the resealable mechanism; (c) place the sealed container in an environmental chamber at conditions of 80% relative humidity and 72° F.; (d) after one day, weigh the container containing the molecular sieve; (e) after approximately two weeks, weigh the container; and (f) subtract the first day sample from the value obtained and divide by the number of days to calculate the moisture ingress of the container in units of micrograms of water/day.

The child resistant container of the present invention may typically be made of a polymer material that provides adequate protection for the product packaged in the container. The vial and lid may be made from the same or different polymer material. Depending on the requirements of the pharmaceutical product, barrier materials such as polyvinyl chloride, polyethylene vinyl acetate, polyethylene, polypropylene, and poly vinylidene chloride may be used. In another embodiment, non-barrier materials may also be used. Non-barrier thermoplastic materials include polystyrene, polycarbonate, polyester terephthalate, polybutylene, metallocene catalyzed polyolefins and poly maleic anhydride. In a particular embodiment, the material may be high-density polypropylene. In another embodiment, the material may be polyethylenevinylacetate.

Example 1

Example 1 details the testing method and test results for a Child-Resistant Test conducted on the present invention to ensure its compliance with ISO 8317 (2015). This test was performed on an embodiment of the present invention in which the child-resistant container comprises a vial with a curved side wall. The testing method and results of the test are detailed below.

Child-Resistant Testing Method:

The test was carried out in accordance with ISO 8317 (2015) and comprised two tests with children (one before demonstration and one after demonstration).

The tests with children were conducted in kindergartens, i.e. in surroundings that are familiar to the children. The children were given the package and instructed to try and open the package. The children were further informed that it should not be possible to open the package because it is intended for dangerous content and to make sure that the package is safe, the testers want the children to try and open it. The children were assured that these packages contained only harmless pills, so they shouldn't be scared. The children were requested to open the package in whatever manner they could think of.

The children were given five minutes to try to open the package. Tools or other opening aids were not made available. If a child succeeded in opening the package, he or she remained in the room until the end of the test. After five minutes, the children that were unsuccessful in opening the package were given a practical demonstration of the opening procedure but received no verbal explanation. After the demonstration, the testers repeated the above instructions. Again, the children had five minutes to try to open the package.

During the tests, the children were repeatedly encouraged to try hard to open the package. No attempt was made to stop a child from using their teeth or any other method to open the package.

The test was carried out with 14 children aged 42 months up to and including 51 months. The packages were filled with a neutral substitute product. The testers checked each package for proper functioning prior to the test. The children were chosen in order to have a test group that is as representative as possible. It was checked prior to conducting the tests that the children were healthy judging by appearances, and that their manual skills were not impaired. When selecting the children, the testers also made sure that no participant had taken part in more than one test in the course of the last 12 months. If a child had in fact taken part in such a test, the testers checked that the system tested was of a different design and that the test took place more than two weeks before the new test.

The children were tested in pairs, and care was taken to ensure that the children would not disturb each other. They were repeatedly requested to keep trying hard to open the package. Tips on how to open the package were not given. If adults were in the room together with the children, the testers made sure that they did not influence the children in any manner. Their presence was documented in the records.

Child-Resistant Testing Results:

0 (Zero) openings were registered in the first five minute test period (before demonstration). In the full ten minute test, 0 (zero) openings were registered. This corresponds to a percentage of 0.0% before demonstration and a total percentage of 0.0%. Thus, the package complies with the child test requirements of Standard ISO 8317 (2015). ISO 8317 allows an opening proportion of 15% (fifteen percent) before and 20% (twenty percent) after demonstration. The results are within the tolerance range of the regulations.

Example 2

Example 2 details the testing method and test results for a Senior Adult Test conducted on the present invention to ensure its compliance with the requirements of Standard ISO 8317 (2015). This test was performed on an embodiment of the present invention in which the child-resistant container comprises a vial with a curved side wall. The testing method and results of the test are detailed below.

Senior Adult Testing Method:

At the beginning of the test, the adults were asked: "is your job in any way related to the production of child-resistant packaging"? Only if this question is answered in the negative, will the tester proceed with the test and give the following instructions: "squeeze the child resistant tabs on each side. Flip up the top of the vial. Turn upside down and shake to remove lozenges". An enlarged version of the pictogram printed on the closure may be shown or read out to an adult participating in the test only if he/she is unable to read the instructions.

No demonstration of how to open or reclose the package was given to the adults. Acting independently, a period of five minutes was allowed for the adult participants to familiar themselves with the package to be tested by reading the opening and closing instructions and attempting to open and reclose it properly. The participants that were successfully able to open the test package within the five minute period were given a new identical package with a request to open and reclose it as quickly as possible. A one minute test period was allowed for the participants to open and properly reclose the second identical package.

The adult tests were conducted with 20 people. In accordance with ISO 8317 (2015), 70% of the adults tested were female; 30% were male; 25% were aged 50-54; 25% were aged 55-50, and 50% were aged 60-70. The adult participants were given the necessary instructions in writing. The instructions were read to an adult participant only if he/she was unable to read it by himself or herself. The adult participants were chosen at random and had no visible physical impairment. If any impairment (e.g. impaired hand movement) became evident during the test, the results were not counted, and the impairment was documented in the rest records.

Senior Adult Testing Results:

The results, 0 (zero) unsuccessful first attempts, 0 (zero) unsuccessful second attempts and 0 (zero) unsuccessful re-closings are within the tolerance range allowed by ISO-8317. Thus, the package complies with the adult test requirements of Standard ISO 8317 (2015). ISO 8317 allows a rate of 10% (ten percent) of unsuccessful openings and closings.

Example 3

Example 3 details the testing method and test results for a Child-Resistant Test conducted on the present invention to ensure its compliance with ISO 8317 (2015). This test was performed on an embodiment of the present invention in which the child-resistant container comprises a vial with a straight side wall. The testing method and results of the test are detailed below.

Child-Resistant Testing Method:

The test was carried out in accordance with ISO 8317 (2015) and comprised two tests with children (one before demonstration and one after demonstration).

The tests with children were conducted in kindergartens, i.e. in surroundings that are familiar to the children. The children were given the package and instructed to try and open the package. The children were further informed that it should not be possible to open the package because it is intended for dangerous content and to make sure that the package is safe, the testers want the children to try and open it. The children were assured that these packages contained only harmless pills, so they shouldn't be scared. The children were requested to open the package in whatever manner they could think of.

The children were given five minutes to try to open the package. Tools or other opening aids were not made available. If a child succeeded in opening the package, he or she remained in the room until the end of the test. After five minutes, the children that were unsuccessful in opening the package were given a practical demonstration of the opening procedure but received no verbal explanation. After the demonstration, the testers repeated the above instructions. Again, the children had five minutes to try to open the package.

During the tests, the children were repeatedly encouraged to try hard to open the package. No attempt was made to stop a child from using their teeth or any other method to open the package.

The test was carried out with 14 children aged 42 months up to and including 51 months. The packages were filled with a neutral substitute product. The testers checked each package for proper functioning prior to the test. The children were chosen in order to have a test group that is as representative as possible. It was checked prior to conducting the tests that the children were healthy judging by appearances, and that their manual skills were not impaired. When selecting the children, the testers also made sure that no participant had taken part in more than one test in the course of the last 12 months. If a test child had in fact taken part in such a test, the testers checked that the system tested was of a different design and that the test took place more than two weeks before the new test.

The children were tested in pairs, and care was taken to ensure that the children would not disturb each other. They were repeatedly requested to keep trying hard to open the package. Tips on how to open the package were not given. If adults were in the room together with the children, the testers made sure that they did not influence the children in any manner. Their presence was documented in the records.

Child-Resistant Testing Results:

0 (Zero) openings were registered in the first five minute test period (before demonstration). In the full ten minute test, 0 (zero) openings were registered. This corresponds to a percentage of 0.0% before demonstration and a total percentage of 0.0%. Thus, the package complies with the child test requirements of Standard ISO 8317 (2015). ISO 8317 allows an opening proportion of 15% (fifteen percent) before and 20% (twenty percent) after demonstration. The results are within the tolerance range of the regulations.

Example 4

Example 4 details the testing method and test results for a Senior Adult Test conducted on the present invention to ensure its compliance with the requirements of Standard ISO 8317 (2015). This test was performed on an embodiment of the present invention in which the child-resistant container comprises a vial with a straight side wall. The testing method and results of the test are detailed below.

Senior Adult Testing Method:

At the beginning of the test, the adults were asked: "is your job in any way related to the production of child-resistant packaging"? Only if this question is answered in the negative, will the tester proceed with the test and give the following instructions: "squeeze the child resistant tabs on each side. Flip up the top of the vial. Turn upside down and shake to remove lozenges". An enlarged version of the pictogram printed on the closure may be shown or read out to an adult participating in the test only if he/she is unable to read the instructions.

No demonstration of how to open or reclose the package was given to the adults. Acting independently, a period of five minutes was allowed for the adult participants to familiar themselves with the package to be tested by reading the opening and closing instructions and attempting to open and reclose it properly. The participants that were successfully able to open the test package within the five minute period were given a new identical package with a request to open and reclose it as quickly as possible. A one minute test period was allowed for the participants to open and properly reclose the second identical package.

The adult tests were conducted with 20 people. In accordance with ISO 8317 (2015), 70% of the adults tested were female; 30% were male; 25% were aged 50-54; 25% were aged 55-50, and 50% were aged 60-70. The adult participants were given the necessary instructions in writing. The instructions were read to an adult participant only if he/she was unable to read it by himself or herself. The adult participants were chosen at random and had no visible physical impairment. If any impairment (e.g. impaired hand movement) became evident during the test, the results were not counted, and the impairment was documented in the rest records.

Senior Adult Testing Results:

The results, 0 (zero) unsuccessful first attempts, 0 (zero) unsuccessful second attempts and 0 (zero) unsuccessful re-closings are within the tolerance range allowed by ISO-8317. Thus, the package complies with the adult test requirements of Standard ISO 8317 (2015). ISO 8317 allows a rate of 10% (ten percent) of unsuccessful openings and closings.

What is claimed is:

1. A child-resistant container comprising:

a lid having a side wall, an inner surface and a lid cover, the lid cover including a top surface, a bottom surface, a front surface, and at least two lid hooks located on opposing sides of the lid protruding from the bottom surface; and a vial having a top, a bottom, and a side wall, the top containing an opening accessing a cavity and a rim extending around at least a portion of the opening having a front portion extending along the entire front of the rim, the rim having at least two moveable tabs located on opposing sides of the vial partially affixed to the rim and each movable about two pivot points, wherein the moveable tabs are provided towards the leading edge of the vial on either side of the front portion connected to the front portion by one pivot point and connected to the rim by another pivot point on the opposite side of the moveable tab, wherein the movable tabs contain tab hooks above the pivot point for engaging with the lid hooks to secure the lid cover to the vial, and wherein the moveable tabs are displaceable outwardly away from the lid to disengage the tab hooks from the lid hooks by pressing inwardly on the moveable tabs below the pivot points, and wherein the bottom surface of the lid cover comprises a plug having a side wall and a ridge and the inner surface of the lid comprises a plug opening accessing the cavity of the vial, wherein the plug on the bottom surface of the lid cover fits into the plug opening to seal the plug opening and the ridge fits within a groove formed between the inner surface and the rim of the vial when the child-resistant container is in a closed position.

2. The child-resistant container according to claim 1, wherein the lid hooks do not extend beyond a perimeter of the lid of the child-resistant container.

3. The child-resistant container according to claim 1, wherein the tab hooks do not extend above the top of the tabs of the vial of the child-resistant container.

4. The child-resistant container according to claim 1, wherein the seal between the plug and the plug opening is moisture tight and resealable.

5. The child-resistant container of claim 1, wherein the lid further comprises at least two guides extending from a bottom surface of the lid to direct content within the vial through the plug opening.

6. The child-resistant container according to claim 5, wherein the guides are positioned on opposing sides around the plug opening.

7. The child-resistant container according to claim 1, wherein the lid of the child-resistant container comprises a chamber having a top surface, bottom surface and a side wall extending around at least a portion of the circumference of the chamber, wherein the chamber is attached to the bottom surface of the lid.

8. The child-resistant container according to claim 7, wherein the chamber comprises a desiccant reservoir to hold a desiccant extending from the bottom surface of the lid into the cavity of the vial.

9. The child-resistant container according to claim 8, wherein the desiccant is in the form of silica gel beads.

10. The child-resistant container according to claim 1, wherein the child-resistant container is 100% child resistant as determined by a Child-Resistant Test.

11. The child-resistant container according to claim 1, wherein the child-resistant container is 100% senior friendly as determined by a Senior Adult Test.

12. The child-resistant container according to claim 1, wherein the vial and the lid are made from different polymer materials.

* * * * *